US006182849B1

(12) United States Patent
Elstone, Sr.

(10) Patent No.: US 6,182,849 B1
(45) Date of Patent: Feb. 6, 2001

(54) COLLAPSIBLE BOX

(76) Inventor: Paul J. Elstone, Sr., 420 Main St., Medford, NJ (US) 08055

( * ) Notice: Under 35 U.S.C. 154(b), the term of this patent shall be extended for 0 days.

(21) Appl. No.: 09/459,559

(22) Filed: Dec. 13, 1999

Related U.S. Application Data

(63) Continuation of application No. 09/096,796, filed on Jun. 12, 1998, now Pat. No. 6,032,815.

(51) Int. Cl.[7] ..... B65D 6/18

(52) U.S. Cl. ..... 220/6; 220/4.29; 220/4.28; 206/600

(58) Field of Search ..... 220/6, 4.29, 4.28, 220/7, 666, 1.5, 507, 500, 527, 62, 720; 206/600, 386

(56) References Cited

U.S. PATENT DOCUMENTS 1,673,769 * 6/1928 Graham ..... 220/6
4,606,461 * 8/1986 Bolton, Sr. ..... 206/600
5,318,219 * 6/1994 Smith ..... 229/117.05
5,323,921 * 6/1994 Olsson ..... 217/12 R
5,564,599 * 10/1996 Barber et al. ..... 222/105
5,829,595 * 11/1998 Brown et al. ..... 206/600

* cited by examiner

*Primary Examiner*—Stephen Castellano
(74) *Attorney, Agent, or Firm*—Walter J. Tencza Jr.

(57) ABSTRACT

A folding box is provided including a bottom panel having a rear edge, a left edge, a right edge and a front edge. A lip extends along the edges of the bottom panel. A rear panel is permanently hinged to the rear lip. The rear panel has a left edge and a right edge. A rear left side panel is permanently hinged to the rear panel along the left edge of the rear panel. A front left side panel is permanently hinged to the rear left side panel along an edge distal to the rear panel. A rear right side panel is permanently hinged to the rear panel along the right edge of the rear panel. A front right side panel is permanently hinged to the rear right side panel along an edge distal to the rear panel. A front panel has a left edge and a right edge. The front panel's left edge is permanently hinged to the front left side panel along an edge distal to the rear left side panel. The front panel's right edge is permanently hinged to the front right side panel along an edge distal to the rear right side panel.

3 Claims, 7 Drawing Sheets

COLLAPSIBLE BOX

CLAIM FOR PRIORITY

This application is a continuation of parent application Ser. No. 09/096,796 filed on Jun. 12, 1998, now Pat. No. 6,032,815 and this application claims the priority of parent application Ser. No. 09/096,796.

BACKGROUND OF THE INVENTION

This invention is directed to the field of shipping, storage and delivery of materials. In particular, the invention is directed to a box for storing objects and materials which is capable of being stacked while filled and then collapsed for convenient storage and return shipping when not filled.

Various materials and objects require special packaging when shipping. These objects can be too small to carry efficiently by themselves or may be too delicate to survive the travails of shipping unprotected. This can be particularly true when the objects are transported as freight in trains, planes or ships. Due to the nature of these vehicles, a certain amount of jostling is unavoidable. Further, skilled laborers are required to load these vehicles. Consequently, convenient packaging will reduce the loading and unloading time, thus reducing overall costs.

While it is important to provide sturdy packaging for transported objects, these containers can themselves create difficulties. In particular, the containers often must be returned via the same vehicles. Although the vehicles are capable of carrying the weight of a great number of empty containers, the large size of the containers requires a large amount of storage space, restricting the number of containers which can be returned and resulting in the inefficient use of storage space on a return trip.

Various containers have been developed over the years in an effort to provide a collapsible container for different materials. U.S. Pat. No. 4,742,951 is directed to a container for bulk flowable materials. An octagonal-shaped cardboard sleeve is attached to a bottom end cap. The adjacent panels of the sleeve are connected along elongate edges. A tubular inner member which is designed to withstand the pressure of the contained material is inserted inside the octagonal sleeve. A top end cap is attached to the top of the sleeve.

U.S. Pat. Ser. No. 4,927,026 is directed to pallet box. Side walls of a container are hinged to the surface of a pallet. A tubular cardboard sleeve is positioned about the side walls and maintains the container shape. The container can be formed by criss-crossing panels attached to the pallet.

U.S. Pat. Ser. No. 5,178,275 is directed to an eight-sided columnar container for supporting bulk materials in sacks. An eight-sided collapsible sleeve is mounted to pallet. Tabs are positioned along the bottom edge of each side of the container. Alternating tabs are bent inward or outward. The sacks of materials are disposed within the sleeve and a cap may be positioned on top of the sleeve.

U.S. Pat. Ser. No. 5,441,154 is directed to a integrated paperboard container and pallet system. The wall portion of the container has a polygonal-shaped interior cavity. At least one tab is formed at the bottom of one of the walls. The deck portion has a planar member with an upper side forming a floor surface and a lower side forming a support surface. Edges are mounted to the planar member and have the same polygonal shape as the wall portion. Openings are positioned in the planar member to receive any tabs. The planar member is designed to be mounted to a pallet, if desired. The wall portion can be folded when it is not attached to the planar member.

U.S. Pat. Ser. No. 4,511,080 is directed to interlocking end closure flaps on collapsible eight-sided receptacle. The receptacle is formed of a single blank of foldable sheet material. The flaps positioned along the bottom edges of the receptacle fold over to form the bottom of the container.

U.S. Pat. Ser. No. 5,269,414 is directed to an intermediate bulk container. The side walls of the container are made of a rigid material and are hinged to the base using one- or two-directional hinges. Sealing strips or separate bags are provided to prevent any leaking of material through the hinge. The bottom panel of the container may be ramped to direct the flow of material from the container. A cutting means can be provided at the exit of the container to allow for opening any internal bag holding the material.

U.S. Pat. Ser. No. 5,253,763 is directed to a collapsible container. The walls of the container are mounted by long, horizontal hinges attached to the walls. This container can be palletized.

U.S. Pat. Ser. No. 5,507,392 is directed to a pallet container with adapter frame. A hinged support insert is provided that folds upon itself using both internal and external hinges. The container may be provided with a plastic, sloped bottom.

None of these patents fully address the problems resolved by the instant invention.

SUMMARY OF INVENTION

It is an object of an aspect of the instant invention to provide a collapsible container which is sturdy enough to carry substantial loads and yet can be folded into a space-saving, self contained configuration for later use.

It is another object of an aspect of this invention to provide a collapsible container which can be stacked for efficient storage and transportation.

It is another object of an aspect of this invention to provide a container which allows access to the stored materials from a side panel without endangering the structural integrity of the container.

It is another object of an aspect of this invention to provide a materials container which can be used repeatedly despite heavy cargo weights and rough handling.

In accord with one aspect of the invention, a folding box is provided including a bottom panel having a rear edge, a left edge, a right edge and a front edge. A lip extends along the edges of the bottom panel. The lip is composed of a rear lip attached to the rear edge, a left lip attached to the left edge, a right lip attached to the right edge and a front lip attached to the front edge. A rear panel is permanently hinged to the rear lip. The rear panel has a left edge and a right edge. A rear left side panel is permanently hinged to the rear panel along the left edge of the rear panel. A front left side panel is permanently hinged to the rear left side panel along an edge distal to the rear panel. A rear right side panel is permanently hinged to the rear panel along the right edge of the rear panel. A front right side panel is permanently hinged to the rear right side panel along an edge distal to the rear panel. A front panel has a left edge and a right edge. The front panel's left edge is permanently hinged to the front left side panel along an edge distal to the rear left side panel. The front panel's right edge is permanently hinged to the front right side panel along an edge distal to the rear right side panel.

Certain implementations of this aspect of the invention provide that; a door is mounted to the front panel which can be selectively opened to provide access to the interior of the box; the door comprises a left door hinged to the front panel proximate to the front panel's left edge and a right door hinged to the front panel proximate to the front panel's right edge, wherein the left door and the right door are movable from a closed position in which the left door and the right door abut, to an open position in which the right door and the left door are apart; the left side panels have a total length that is less than the length of the rear panel and the right side panels have a total length that is less than the length of the rear panel, such that the left side panels and the right side panels can be folded inward against the rear panel; a lid is selectively attached to the lip, the lip and the lid are sized to enclose the front panel, the rear panel and the side panels when the panels are folded closed against the bottom panel; flanges are mounted to the lid proximate to its side edges and the side panels of the box are disposed in the flanges; channels are mounted to the bottom panel distal to the lips; top tabs are mounted to the top of the lid, which top tabs are sized to engage the channels; a front tab is mounted to the front lip and defines a front cavity, which front cavity is sized to receive the front panel in snug fit.

In accord with yet another aspect of the invention, a collapsible box for use in transporting and storing objects is provided. A bottom panel has a front edge, a rear edge, a left edge and a right edge. A bottom hinge is mounted to the bottom panel along the rear edge. The box includes an upper sleeve mounted to the bottom panel. A rear panel of the upper sleeve has a rectangular shape with a bottom edge, a left edge, a right edge and a top edge. The rear panel is attached along its bottom edge to the bottom hinge. A left side panel with a left central hinge is hingedly mounted to the rear panel along the left edge of the rear panel. A right side panel with a right central hinge is hingedly mounted to the rear panel along the right edge of the rear panel. A front panel with a right edge and a left edge is hingedly attached to the left side panel at the left edge and the right side panel at the right edge. The rear panel is substantially the same length as the rear edge of the bottom panel. The left side edge is substantially the same length as the left edge of the bottom panel. The right edge is substantially the same length as the right edge of the bottom panel. The front panel is substantially the same length as the front edge of the bottom panel. The upper sleeve is foldable from an assembled position in which the front panel extends along the front edge of the bottom panel, the right side panel extends along the right side edge of the bottom panel and the left side panel extends along the left side edge of the bottom panel, to a closed position in which the side panels are folded about their respective central hinges onto the rear panel and the bottom panel, the front, side and rear panels extend in parallel planes.

Certain implementations of this aspect of the invention provide that: in the assembled position, the front panel, the left side panel, the right side panel and the rear panel extend in planes perpendicular to the bottom panel; a lid is selectively attached to the bottom panel when the upper sleeve is in the closed position.

In accord with another aspect of the invention, a collapsible box has a bottom panel with a front edge, a rear edge, a left side edge and a right side edge. A rear panel is attached to the rear edge of the bottom panel by an internal hinge. A first side panel is attached to the rear panel along a first edge of the rear panel by a first internal hinge. A second side panel is attached to the rear panel along a second edge of the rear panel distal to the first edge, by a second internal hinge. A first central external hinge extends along a first panel axis of the first side panel. A second central external hinge extends along a second panel axis of the second side panel. A front panel is attached to the first panel distal to the rear panel by a first front internal hinge. The front panel is attached to the second panel distal to the rear panel by a second front internal hinge.

The material of the panels is selected such that the upper sleeve has adequate structural integrity to support the weight of, at least, a second, loaded box placed on top of the lid, as well as to contain the dense material within the box during storage and transport.

DESCRIPTION OF PREFERRED EMBODIMENTS

Figure 1:
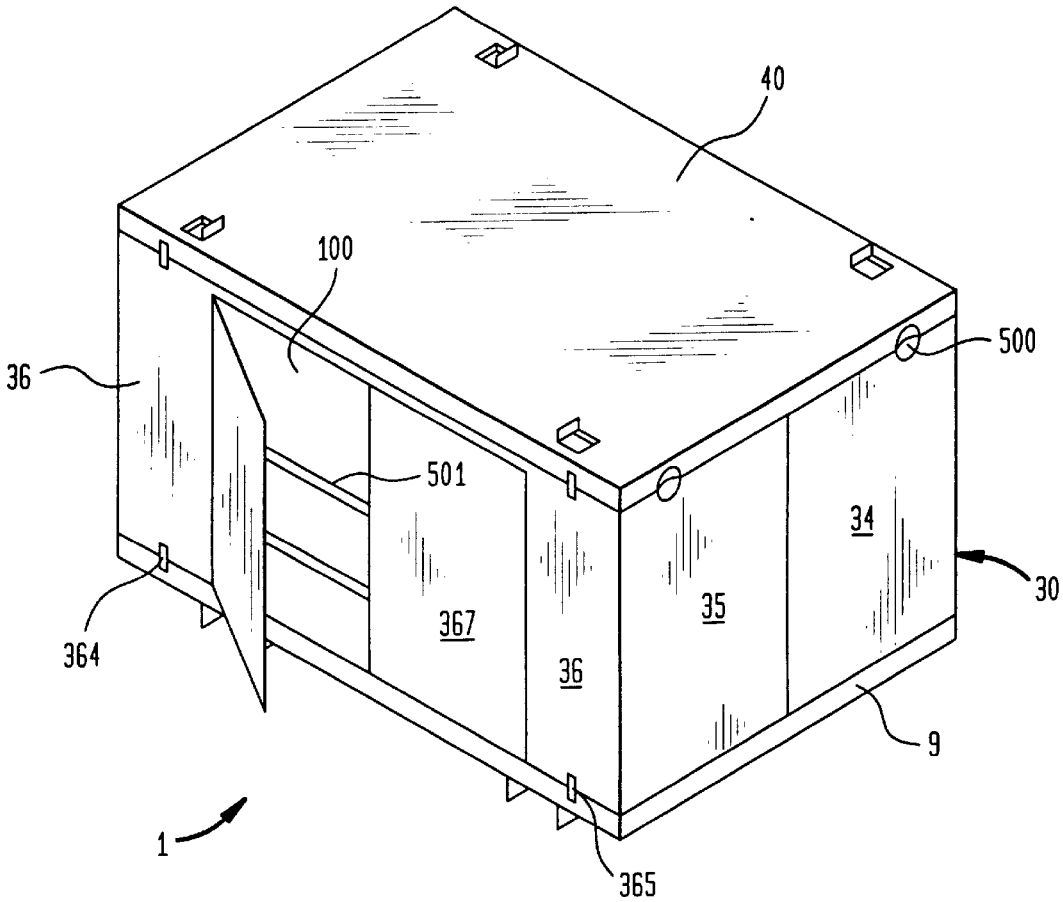
FIG. 1 is a perspective view of a collapsible box in accord with the instant invention in an assembled condition.

Referring to FIG. 1, the box 1 of the instant invention includes an upper sleeve 30 attached to a base 9. A lid 40 is selectively engaged to the upper sleeve at its top. The upper sleeve is composed of a front panel 36 and a rear panel 31 attached by a left side panel 101 and a right side panel 102 (see also, FIG. 2). As discussed more fully below, central hinges are provided in the side panels, allowing them to fold in half onto the front and rear panels. Consequently, it is preferred that the total length of each side panel does not exceed the length of the rear panel or the front panel. In FIG. 1, the box is in an assembled condition, with the upper sleeve open and the lid attached. An interior cavity 100 for the storage of material is thus formed within the sleeve between the lid and the base. As discussed below with respect to FIGS. 7 and 8, when not in use, the sleeve can be collapsed into the base and the lid attached to the base, enclosing the folded sleeve. The base and the lid can then be latched together securely.

Preferably, the base 9, upper sleeve 30 and lid 40 are made of a rigid material, such as steel or aluminum. Of course, other materials, such as plastic and the like, can be employed and still practice the invention. The material should be selected such that the assembled box can withstand the weight of another box and its contained load stacked on the lid.

Figure 2:
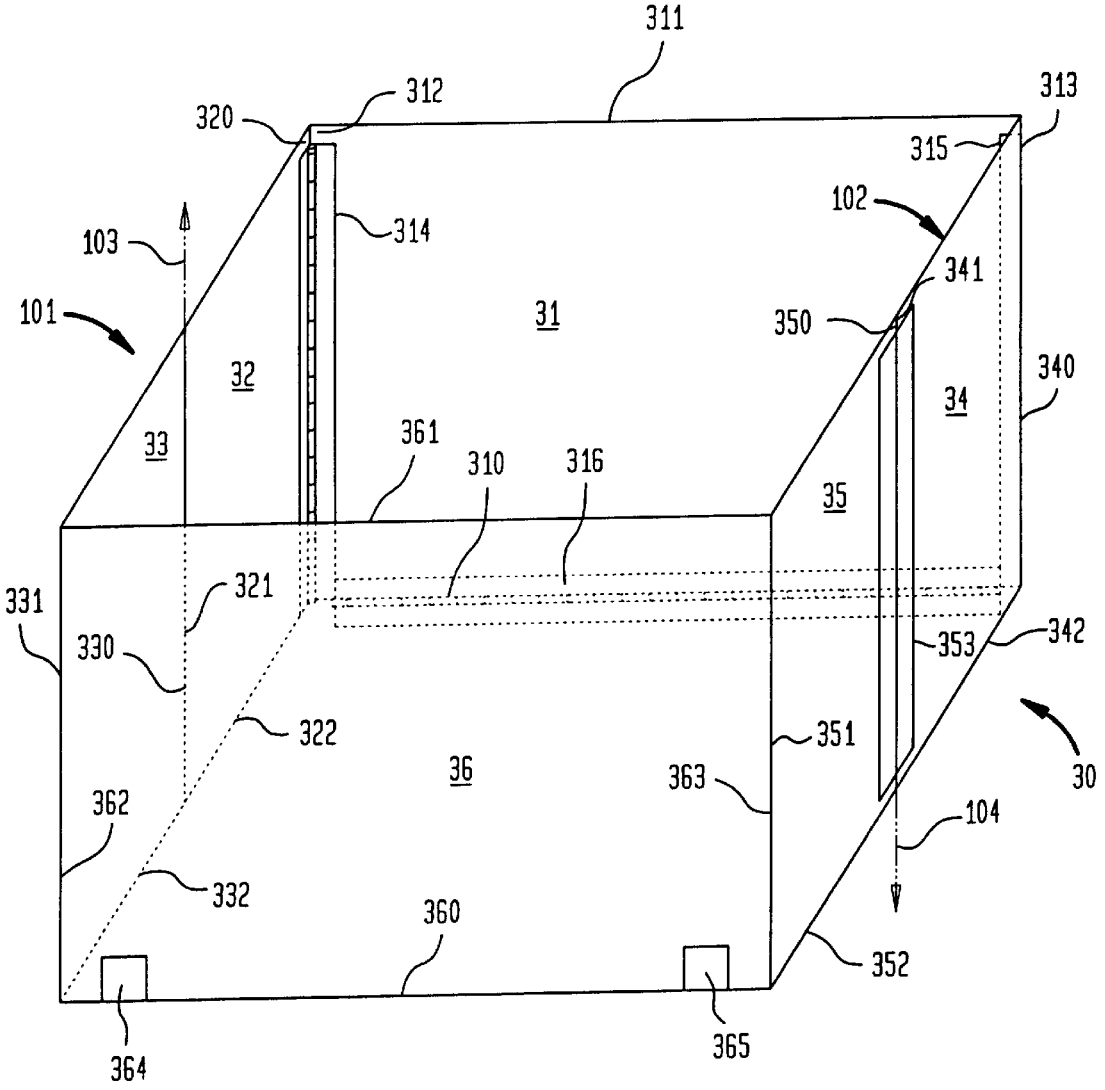
FIG. 2 is a perspective view in isolation of an upper sleeve of the box of FIG. 1.

Referring to FIG. 2, the upper sleeve includes a rear panel 31 connected to a front panel 36 by a right side panel 102 and a left side panel 101. The rear panel has a rectangular shape with a top edge 311, a bottom edge 310, a left edge 312 and a right edge 313. A bottom hinge 316 is attached to the rear panel along the bottom edge. As discussed below, the bottom hinge is attached to the rear lip 15 of the base 9. The bottom hinge is an interior hinge allowing the rear panel to fold inward onto the base. However, as the rear panel is rotated upward, it will engage the rear lip, preventing rotation much beyond a vertical position (i.e., a position perpendicular to the bottom panel 10 of the base).

The left side panel 101 has a rectangular shape with a central vertical axis 103 and is composed of a left rear panel 32 and a left front panel 33 which are attached by a left central hinge, such that the left rear panel can fold onto the left front panel about the central axis. The left rear panel 32 has a rectangular shape and is attached at its rear edge 320 to the rear panel 31 along the left edge 312 of the rear panel by an internal hinge 314. The internal hinge permits the left rear panel to fold onto the rear panel. However, as the left rear panel is rotated outward, the rear panel and the right rear panel engage or abut, restricting further rotation. Preferably, the internal hinge 314 is positioned to restrict the left rear panel from rotating beyond a position perpendicular to the rear panel.

Similarly, the right side panel 102 has a rectangular shape with a central vertical axis 104 and is composed of a right rear panel 34 and a right front panel 35 which are attached by a right central hinge, such that the right rear panel can fold onto the left front panel about the central axis. The right rear panel 34 has a rectangular shape and is attached at its rear edge 340 to the rear panel 31 along the right edge 313 of the rear panel by an internal hinge 315. Again, the internal hinge 315 restricts the movement of the right rear panel to a perpendicular orientation with respect to the rear panel while permitting the right rear panel 34 to fold flat onto the rear panel 31.

The left front panel 33 is attached along its rear edge 330 to the left rear panel 32 along its front edge 321 by an external hinge (not shown). The external hinge permits the front and rear left side panels 32, 33 to fold together or "accordion" (see FIG. 7). The external hinge is positioned such that it otherwise restricts the movements of the left side panels 32, 33 to a parallel, coplanar position, as shown in FIG. 2. In particular, when the left side panels are rotated to a parallel, coplanar position, they abut, preventing further rotation about the external hinge.

Similarly, the right front panel 35 is attached along its rear edge 350 to the right rear panel 34 along its front edge 341 by an external hinge 353. The external hinge permits the right side panels to fold together (see FIG. 7). The external hinge 353 is positioned such that it otherwise restricts the movement of the right side panels 34, 35 to a parallel, coplanar position, as shown in FIG. 2. In particular, when the right side panels are rotated to a parallel, coplanar position, they abut, preventing further rotation about the external hinge 353.

Figure 5:
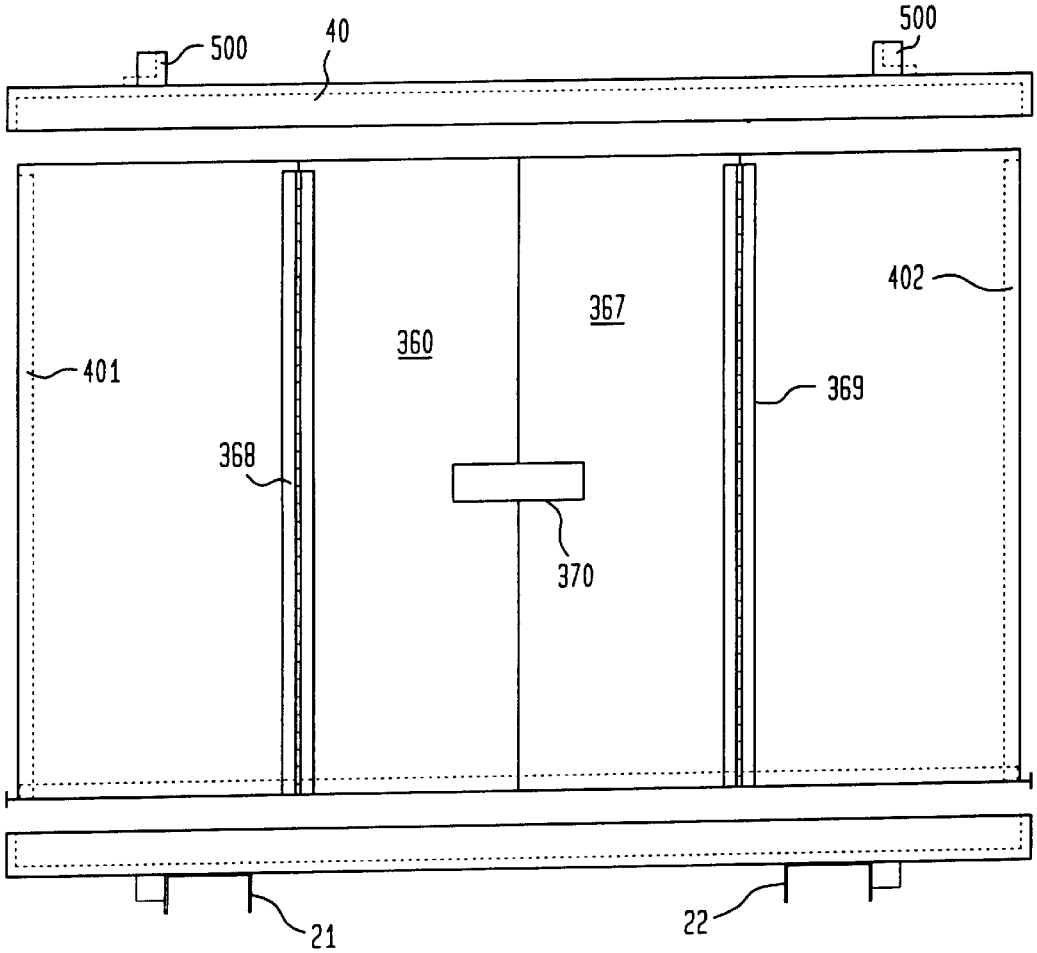
FIG. 5 is a front elevation view of the box of FIG. 1 in an assembled condition.
Figure 6:
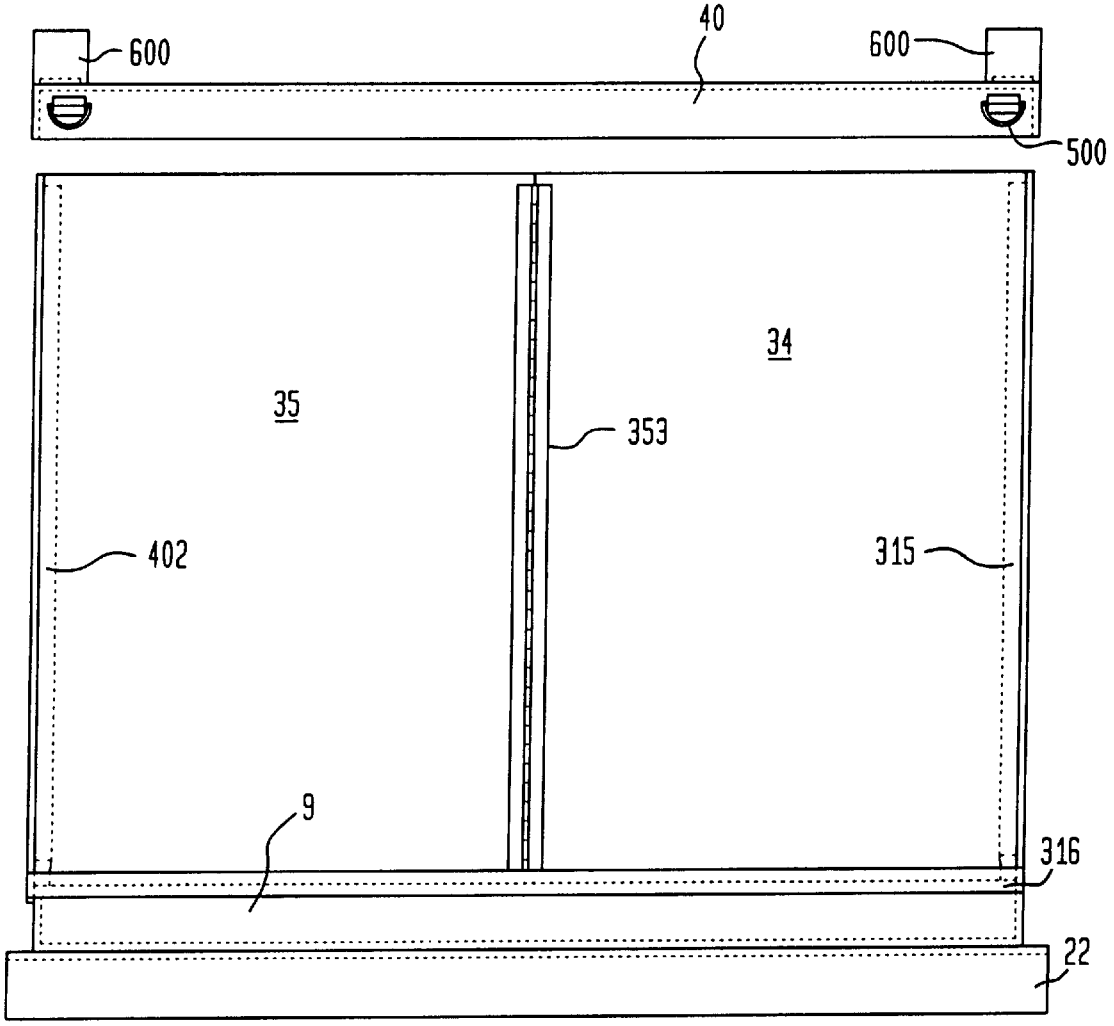
FIG. 6 is a side elevation view of the box of FIG. 1 in an assembled condition.

Referring to FIGS. 5 and 6 as well, the front panel 36 is attached at its left edge 362 to the front edge 331 of the left front panel 33 by an internal hinge 401. The front panel is also attached at its left edge 363 to the front edge 351 of the left front panel 35 by an internal hinge 402. The internal hinges allow the front side panels 33, 35 to fold flat against the front panel. The internal hinges are positioned such that, when the angle between the front panel and each side panel exceeds 90°, the front panel abuts the side panel, preventing further relative rotation (similar to internal hinges 314 and 315 on the rear panel).

Figure 9A:
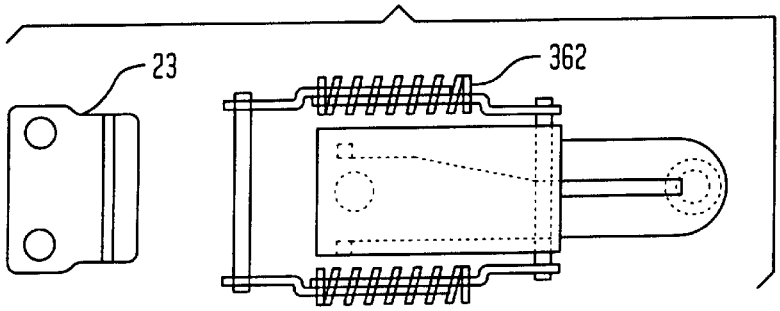
FIG. 9A is a top elevation view of a spring draw latch for use with the box of FIG. 1.
Figure 9B:
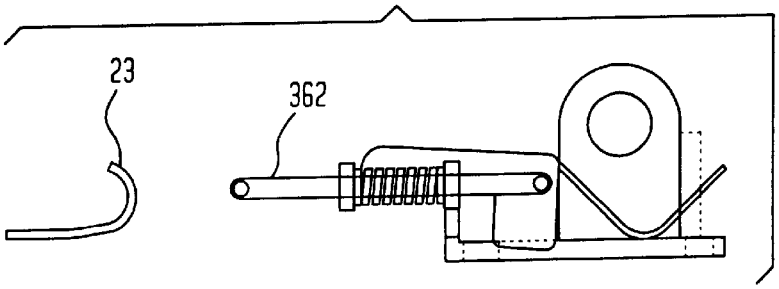
FIG. 9B is a side elevation view of the external spring draw latch of FIG. 9A.

Draw latches 362, 365 are attached to the front panel near the bottom edge 360: one at the left side, one at the right side. The latches are designed to selectively engage the clips 23, 24 on the base 9, discussed below. The latches are preferably external spring latches shown in FIGS. 9A and 9B. Of course, other latches can be employed and practice the invention.

Figure 7:
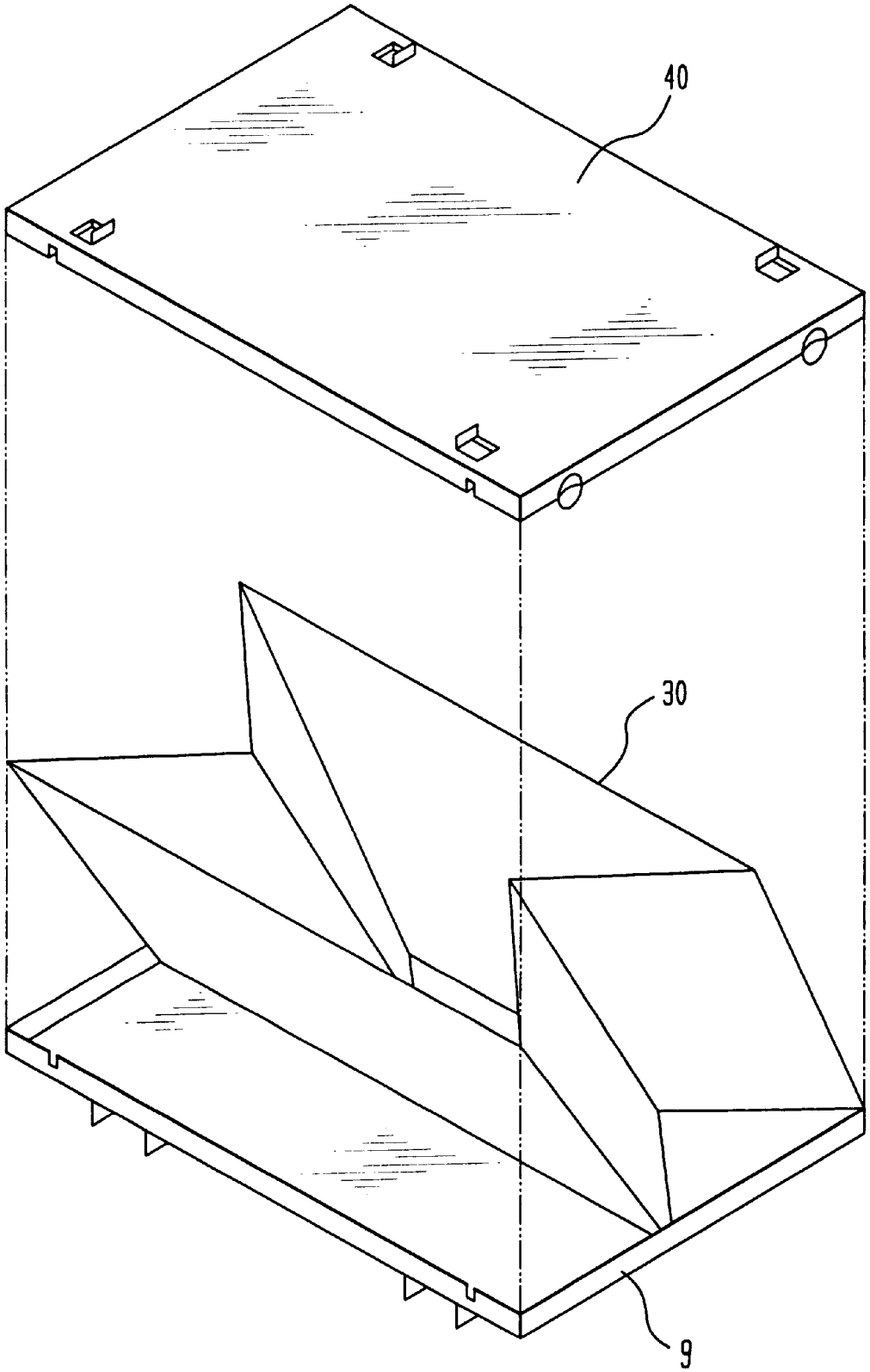
FIG. 7 is a perspective view of the box of FIG. 1 in a partially folded condition.

The upper sleeve 30 is designed such that the panels can be folded to an open or "assembled" position, thereby forming a tube having a rectangular cross section and defining a central cavity 100. As seen in FIG. 7, when the sleeve is not in use, the side panels are folded inward, closing the external hinges 353. The rear side panels 32, 34 are folded flat between the front side panels 33, 35, respectively, and the rear panel. The front side panels 33, 35 are themselves folded flat against the front panel 36. Consequently, the rear panel, the front panel, the rear side panels and the front side panels are all maintained in parallel planes.

Figure 3:
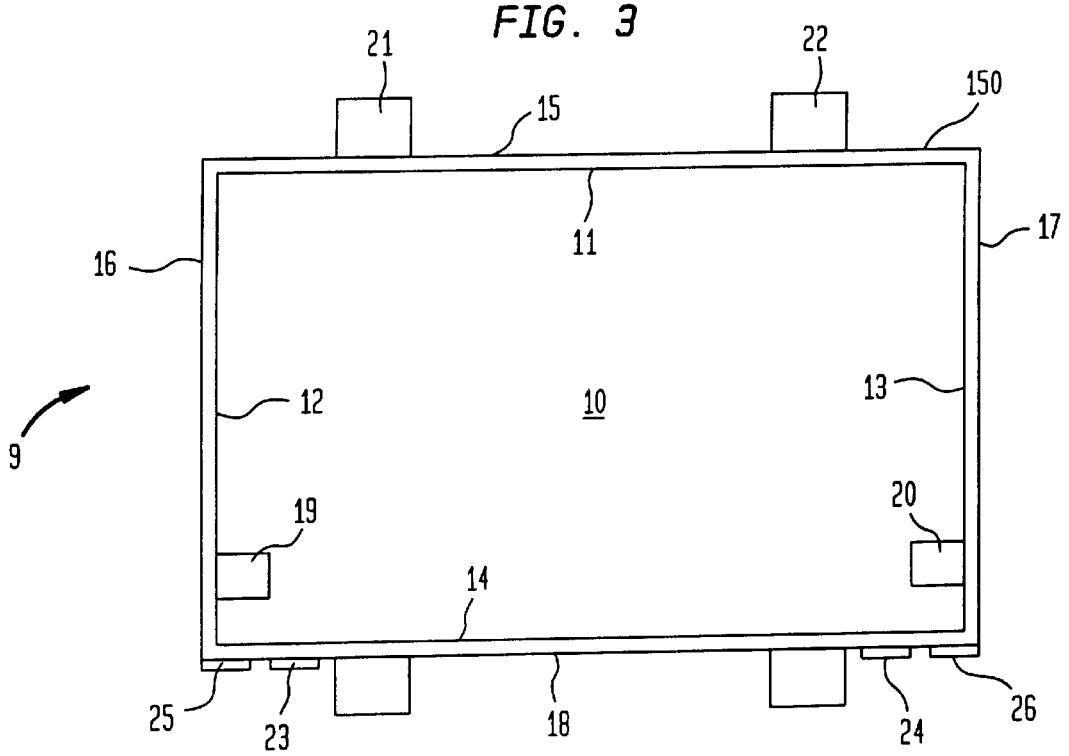
FIG. 3 is a top elevation view in isolation of a base of the box of FIG. 1.

Referring to FIG. 3, the base 9 includes a bottom panel 10 having a rectangular shape with a rear edge 11, a front edge 14, a left edge 12 and a right edge 13. A raised lip 150, composed of a rear lip 15, a front lip 18, a left lip 16 and a right lip 17, extends upward around the periphery of the bottom panel. Preferably, the lip forms a water tight seal at the bottom panel, preventing any fluids from leaking between the lip and the bottom panel. The lip may be integrally formed with the bottom panel.

Figure 10A:
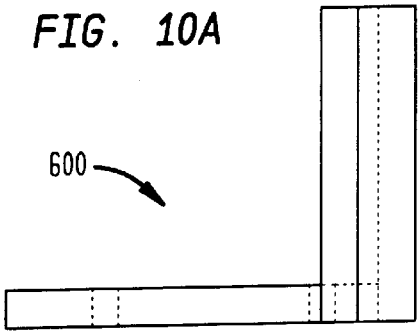
FIG. 10A is a top elevation view of a slide bolt lid latch for use with the box of FIG. 1.
Figure 10B:
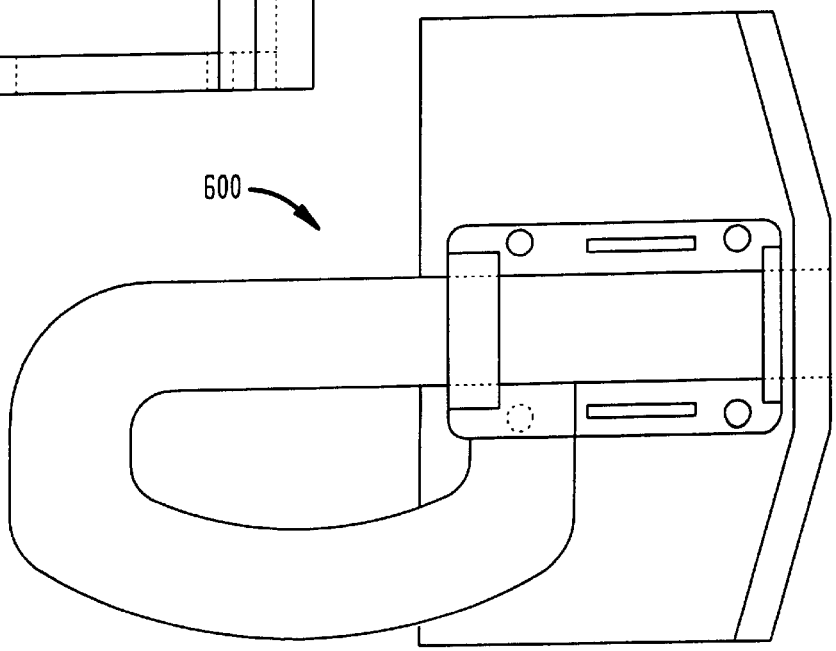
FIG. 10B is a side elevation view of the slide bolt lid latch of FIG. 9A.

Channels 21, 22 are mounted to the bottom panel opposite the lip. The channels are sized to receive fork lift prongs and the like. The channels may have a U-shaped or an L-shaped cross section, as is desired for a particular application. Apertures are provided in the channels, as discussed below, which permit locking the channel of one box with the lid 40 of a second box. Side bolt latches 600, as shown in FIGS. 10A and 10B, can be attached to the lid. The bolts can be selectively engaged to the apertures in the channels.

Guide plates 25, 26 are mounted to the base 9 at the front lip 18. The guide plates help align the front panel 36 with the front lip. The top of the guide plates may be curved outward, away from the bottom panel 10, thereby allowing the guide plates to direct the bottom edge 360 of the front panel downward toward the interior of the front lip.

Risers 19, 20 are attached to the bottom panel 10 and the left lip 16 and the right lip 17, respectively. The risers prevent the folded panels of the upper sleeve 30 from lying flat on the bottom panel 10. Thus, it is easier for a workman to reach in and grasp the sides of the folded panels, rotating them out of the base 9.

Figure 4:
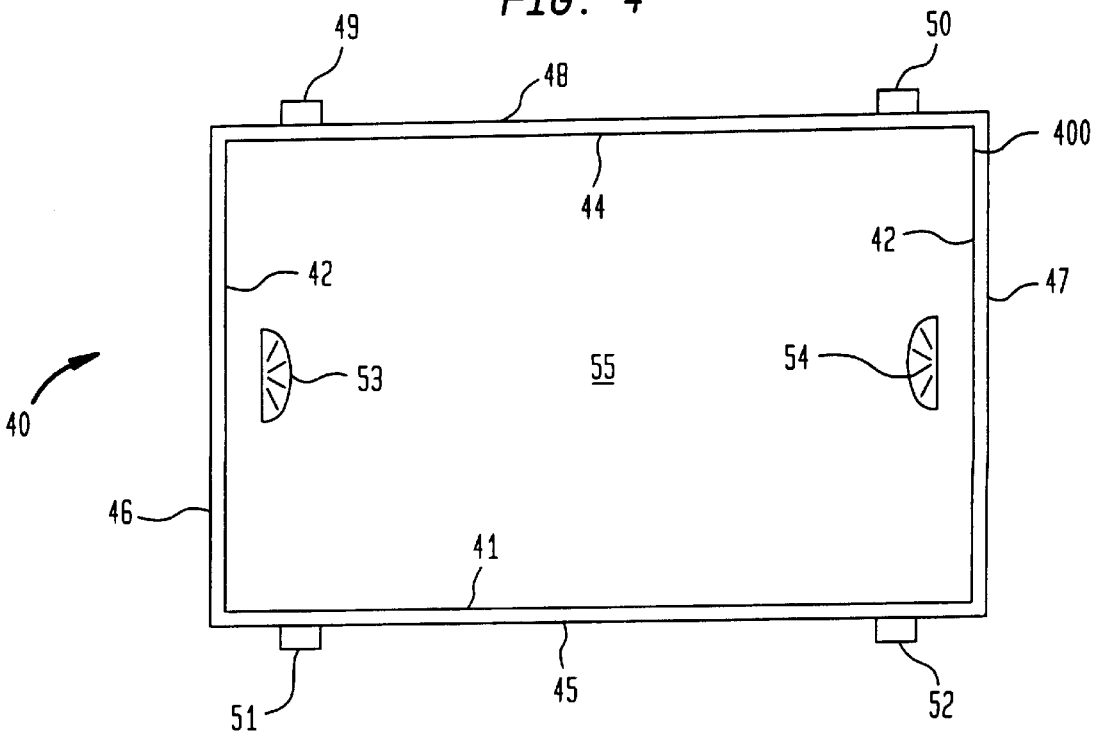
FIG. 4 is a bottom elevation view in isolation of a lid of the box of FIG. 1.

Referring to FIG. 4, the lid 40includes a top panel 55 having a rectangular shape with rear edge 41, a front edge 44, a left edge 42 and a right edge 23. A rim 400 extends around the periphery of the top panel and includes a rear rim 45, a left rim 46, a right rim 47 and a front rim 48. Clasps 49–52 are mounted to the rim at the exterior. Again, it is preferred that the clasps are external spring draw latches shown in FIGS. 9A and 9B, but other clasps can be employed. These clasps are designed to engage clips attached to the front and rear panels. Flanges 53–54 are mounted to the top panel and are curved downward and inward. When the lid is mounted to the upper sleeve 30, the flanges engage the side panels 32,33 and 34,35, pushing them outward and securing them against the side rims 46, 47. This adds stability to the assembled box.

Figure 8:
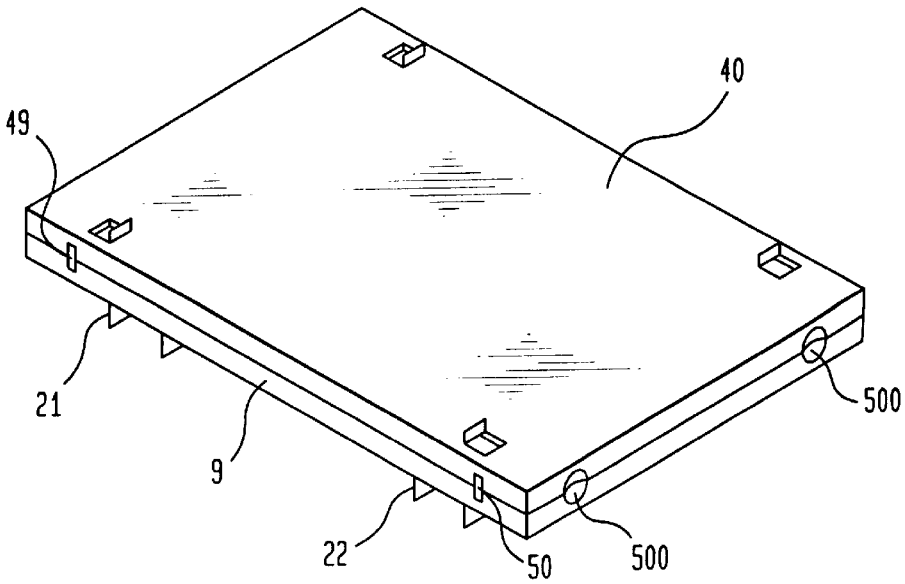
FIG. 8 is a perspective view of the box of FIG. 1 in a closed condition.

When not in use, the box 1 is maintained in a folded and locked position, as seen in FIG. 8. The front panel 36 is folded onto the bottom panel 10. The side panels 32, 33 and 34, 35 are folded together and disposed between the rear panel 31 and the front panel. The lip 150 preferably extends high enough to enclose the folded sleeve 30 completely. The lid 40 is secured directly to the base 9 by the clasps 49–52. Steel loops 500 may be provided for securing the box during shipping. Further, a handle, castors or the like can be provided to make carrying the box easier.

To use the box 1, the clasps 49–52 on the lid 40 are released from the clips 23, 24 on the base 9. The lid is removed. The folded panels are then rotated upward about the bottom interior hinge 316. The side panels 101, 102 are then free to "accordion" outward (see FIG. 7), displacing the front panel 36 from the rear panel 31, and creating the central cavity 100. Once the rear panel 31 is rotated to a position substantially perpendicular to the bottom panel 10, the rear panel starts to abut the rear lip 15, preventing further rotation. The front panel 36 is then displaced forward until it abuts the front lip 18. If the front panel is too high, it may pass over the front lip. However, the guide plates 25, 26 extend above the front lip. Thus, the front panel will engage the guide plates. Once engaged, the front panel can be slid along the surface of the guide plates until the bottom edge 360 of the front panel 36 contacts the bottom panel 10. Once the front panel is in position, the clasps 364,365 on the front panel are engaged to the clips 23, 24 on the base 9. The side panels 32, 33 and 34, 35 will extend along the side lips 17, 18 between the rear panel and the front panel. However, at this point, the side panels will be somewhat loose. Of course, clips or other locking mechanisms can be provided to secure the side panels in position. Further, sliding rods can be provided to secure the right side panels 34, 35 and the left panels 32, 33 into a coplanar position, such as seen in FIG. 2, preventing rotation about the right external hinge 353 or the left external hinge, respectively. As discussed below, this is not believed necessary to practice the invention.

Once the upper sleeve 30 is in place on the base 9, the box 1 can be loaded from the top. When doors 366, 367 are provided in the front panel 36, the door bolt 370 can be unlocked. The left door and the right door can then be opened, providing access to the interior cavity 300. When desired, shelves 501 can be mounted in the box between the panels (see FIG. 1). This may be particularly useful when the box is of a size large enough for a man to walk into.

Once the box 1 has been loaded, the lid 40 is positioned along the top edges of the upper sleeve 30. Once the lid is in place, the clasps 49–52 are engaged to the clips on the top of the front panel and the rear panel. The rim 400 is located outside of the panels of the upper sleeve, thereby limiting their outward movement. The juncture of the right rear panel 34 and the right front panel 35 is positioned between the right flange 54 and the right rim 47. Similarly, the juncture of the left rear panel 32 and the left front panel 33 is positioned between the left flange 53 and the left rim 46. The side panels are thus held in position and prevented from rotating about the exterior hinges. This adds great stability to the box, allowing other loaded boxes to be stacked, shipped and stored thereon.

Once the box is secured in the assembled condition, fork lift prongs can be directed under the bottom panel, engaging the channels 21, 23. In this way, additional pallets are not required for the box. The loaded box can be placed on top of another such box. Apertures are provided in the channels and the top tabs. A locking bolt or ring can be slipped through the apertures, securing the lid of one box to the channels of a second box.

While this invention has been described with reference to specific embodiments disclosed herein, it is not confined to the details set forth and the patent is intended to include modifications and changes which may come within and extend from the following claims.

What is claimed is:

1. A folding box comprising:

a bottom panel having a rear edge, a left edge, a right edge and a front edge;

a raised lip extends along the edges of the bottom panel including a rear lip attached to the rear edge, a left lip attached to the left edge, a right lip attached to the right edge and a front lip attached to the front edge;

a rear panel permanently attached and hinged to the rear lip, the rear panel having a left edge and a right edge;

a rear left side panel permanently hinged to the rear panel along the left edge of the rear panel;

a front left side panel permanently hinged to the rear left side panel along an edge distal to the rear panel;

a rear right side panel permanently hinged to the rear panel along the right edge of the rear panel;

a front right side panel permanently hinged to the rear right side panel along an edge distal to the rear panel; and a front panel having a left edge and a right edge, wherein the front panel's left edge is permanently hinged to the front left side panel along an edge distal to the rear left side panel, and wherein the front panel's right edge is permanently hinged to the front right side panel along an edge distal to the rear right side panel.

2. The box of claim 1 further compromising a door mounted to the front panel which can be selectively opened to provide access to the box.

3. The box of claim 1 wherein the left side panels have a total length that is less than the length of the rear panel and wherein the right side panels have a total length that is less than the length of the rear panel, such that the left side panels and the right side panels can be folded inward against the rear panel.

* * * * *